US006089898A

United States Patent [19]

Lincoln, III et al.

[11] Patent Number: 6,089,898

[45] Date of Patent: Jul. 18, 2000

[54] ELECTRICAL CONNECTOR HAVING AN IMPROVED LATCH MEMBER

[75] Inventors: Clifford Franklin Lincoln, III, Atlanta, Ga.; Larry Hansen Smith, Clemmons, N.C.; Andrew Joseph Kinka, Akron; Hung Viet Ngo, Harrisburg, both of Pa.

[73] Assignee: The Whitaker Corporation, Wilmington, Del.

[21] Appl. No.: 09/036,254

[22] Filed: Mar. 6, 1998

[51] Int. Cl.[7] ..... H01R 13/627

[52] U.S. Cl. ..... 439/357; 439/404; 439/372

[58] Field of Search ..... 439/350, 352–358, 439/372, 404

[56] References Cited

U.S. PATENT DOCUMENTS

| | | | |
|---|---|---|---|
| 4,153,326 | 5/1979 | Frantz et al. . | |
| 4,255,007 | 3/1981 | Michaels et al. . | |
| 4,431,244 | 2/1984 | Anhalt et al. . | |
| 4,526,431 | 7/1985 | Kasukawa . | |
| 4,537,456 | 8/1985 | Brown et al. . | |
| 4,709,976 | 12/1987 | Nakama et al. | 439/350 |
| 4,759,723 | 7/1988 | Siemon | 439/409 |
| 4,990,099 | 2/1991 | Marin et al. | 439/284 |
| 4,995,830 | 2/1991 | Eckhaus | 439/409 |
| 5,127,844 | 7/1992 | Leman et al. | 439/353 |
| 5,639,256 | 6/1997 | Endo et al. | 439/358 |
| 5,662,493 | 9/1997 | Reichle | 439/409 |
| 5,681,182 | 10/1997 | Reichle | 439/417 |
| 5,718,596 | 2/1998 | Inaba et al. | 439/352 |
| 5,895,284 | 4/1999 | Kocher et al. | 439/357 |

*Primary Examiner*—Khiem Nguyen
*Attorney, Agent, or Firm*—Michael J. Aronoff

[57] ABSTRACT

The invention is directed to a latching arm for an electrical connector. The latching arm has a main body with a connection point to the housing of the electrical connector. The main body has a securing section for engaging a mating connector. The main body has a back-up member for engaging the housing. Whereby when the connection point weakens due to stresses on the connection point, the back-up member engages the housing thereby maintaining a good connection between the electrical connector and the mating connector.

11 Claims, 5 Drawing Sheets

ELECTRICAL CONNECTOR HAVING AN IMPROVED LATCH MEMBER

FIELD OF THE INVENTION

The invention is directed to a latch member for securing a connector assembly.

BACKGROUND OF THE INVENTION

It is common for an electrical connector to be provided with a latching member in order to secure the connector with a mating connector. The latching member will ensure that the mating connectors maintain an electrical connection therebetween. Typically, the connector includes an integral latch member which is secured to the housing by a leg or a connection point with the housing. The mating connector has a catch or a lug which will engage the latch member when the two connectors are intermated thereby ensuring that the connectors remain secured together.

U.S. Pat. No. 4,431,244 shows an electrical connector assembly having a latch formed in a wall of one of the connectors. The latch is pivotally mounted by integral live hinge pivots which extend laterally from the sides of the latch so that the lever is pivotable about the latch hinge pivots.

If a large force is applied to the connectors to pull the connectors apart, this force is concentrated in the hinge pivots, the leg, or the connection point of the latching member. If the force is great enough, the hinge points, the legs, or the connection points of the latching member may be become damaged. Once the hinge pivots, the legs, or the connection points of the latching member becomes damaged, the strength of the latching member is weakened and the amount of force needed to pull the connectors apart is lessened.

What is needed is a latch which will still be secured together even under high forces and is still easily released by the operator.

SUMMARY OF THE INVENTION

The invention is directed to a latching arm for an electrical connector. The latching arm has a main body with a connection point to the housing of the electrical connector. The main body has a securing section for engaging a mating connector. The main body has a back-up member for engaging the housing. Whereby when the connection point weakens due to stresses on the connection point, the back-up member engages the housing thereby maintaining a good connection between the electrical connector and the mating connector.

The invention is further directed to a latching arm for an electrical connector. The latching arm is connected to the electrical connector by a leg. The latching arm has an engagement section for engaging a mating connector. The latching arm having a back-up member to engage the electrical connector when the leg is weakened due to stresses.

DETAILED DESCRIPTION OF EMBODIMENTS OF THE INVENTION

U.S. Pat. No. 4,153,326 discloses an electrical connector for use in the building industry, and is hereby incorporated by reference. The present invention is shown as a similar electrical connector for the building industry, however, it is to be understood that the present invention can be used in any electrical connector which requires protection against stronger pull out forces.

Figures 1, 2:
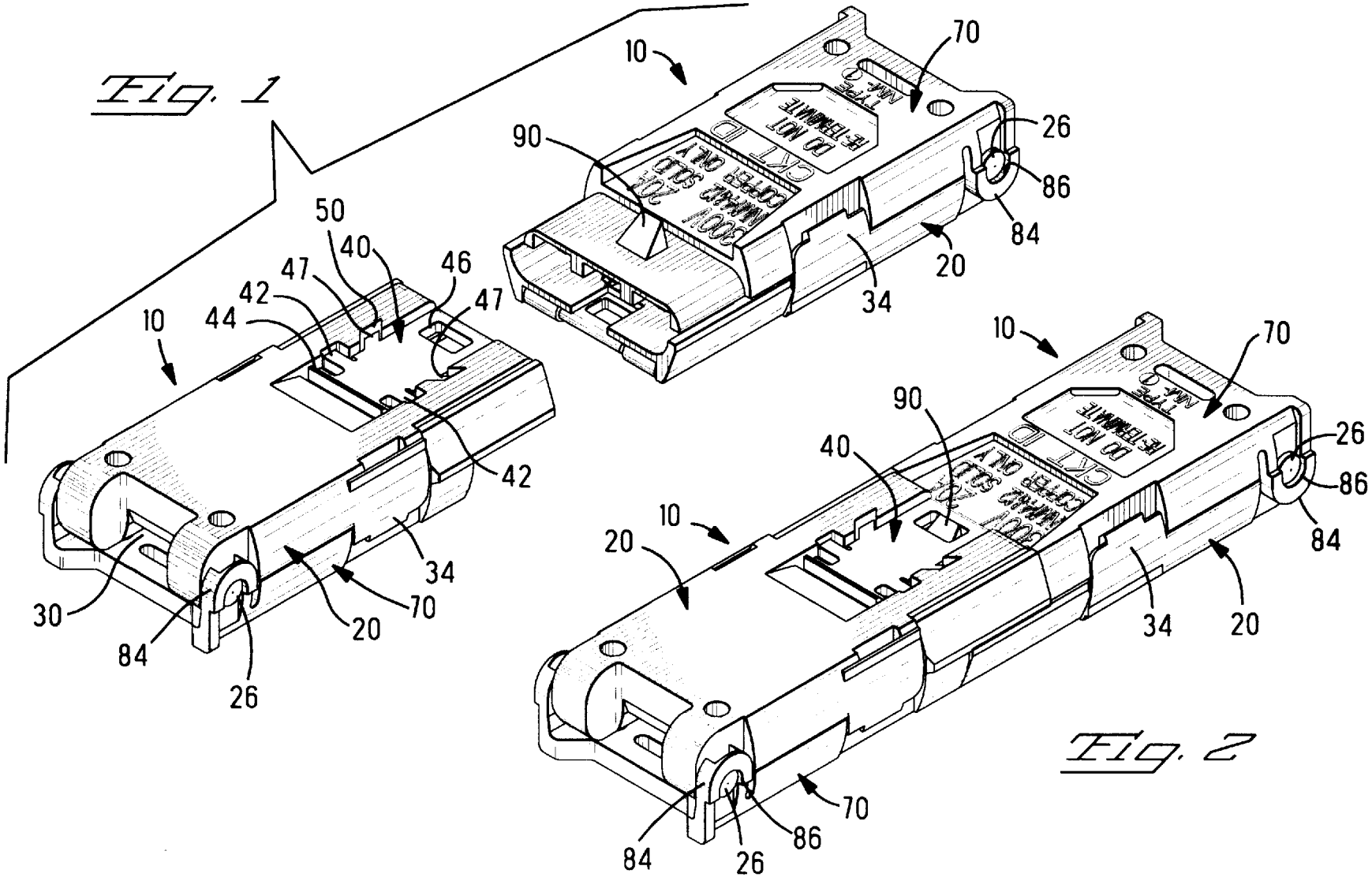
FIG. 1 is an isometric view of two connectors prior to mating.
FIG. 2 is an isometric view of the connectors mated.

FIG. 1 shows an electrical connector 10 which is designed for use with non-metallic building wiring. The electrical connector is a hermaphroditic connector. One of the electrical connectors 10 will mate with an identical electrical connector 10 in the manner shown in FIG. 2, where one connector 10 is upside down with respect to the other connector 10. Both electrical connectors 10 shown in FIGS. 1 and 2 are identical. While the invention is being described with respect to a particular embodiment, it is to be understood that the invention can be used on other connectors.

Connector 10 has cover member 20 and a main housing 70. Housing 70 has contact receiving cavities 72, see FIGS. 3 and 4, with insulation displacement contacts (IDC) 74 secured therein. The contacts 74 each have a mating end 76 and an insulation displacement contact end 78 for terminating a cable thereto. The cable (not shown) is brought into the rearward end 80 of the housing and aligned with the IDC end 78 for termination. The housing 70 has catches 82 along both sides thereof for securing the cover member 20 in a closed position. The housing 70 has two arms 84 along the rearward portion of the housing. The arms 84 have holes 86.

The cover member 20 has an innerside 21, an outerside 22, a forward end 23, and a rearward end 24. Along the rearward end 24 of the cover member 20 are two pivot lugs 26. Each of these lugs extend laterally from the cover member 20 and are designed to be received in a pivotable manner into hole 86. When lugs 26 are received within the holes 86 the cover member 20 is allowed to rotate about the lugs 26.

Figure 4:
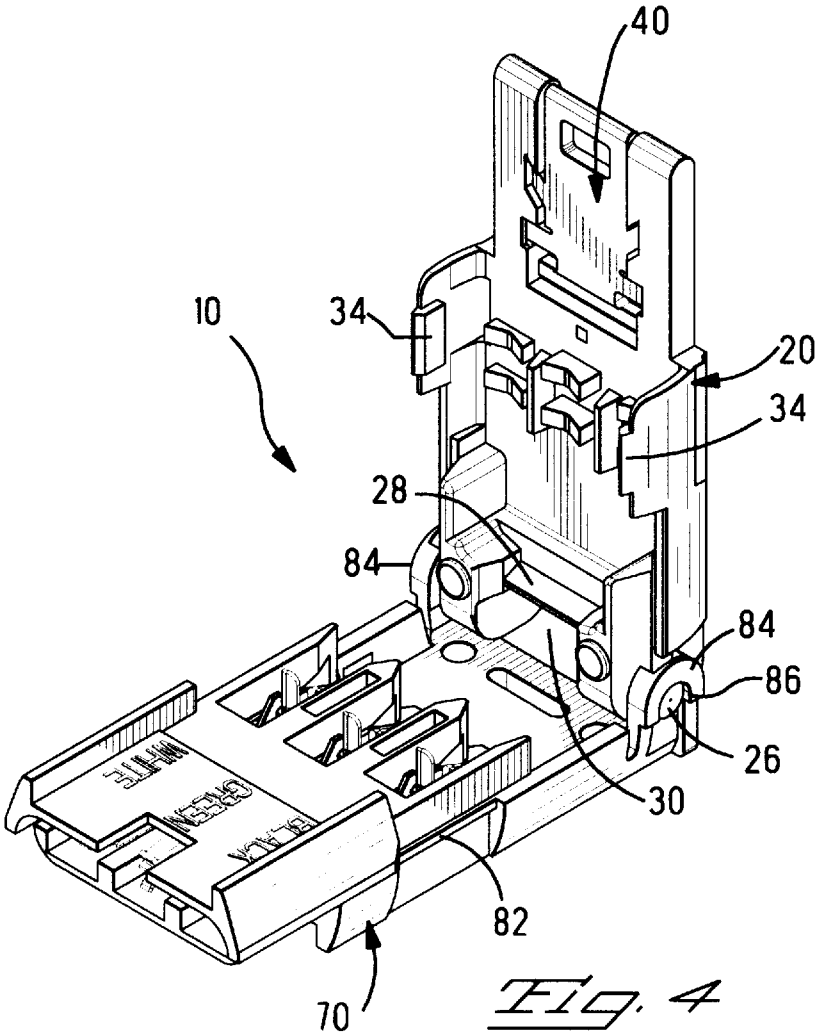
FIG. 4 is an assembled view of the electrical connector.

Along the rearward end 24, on the inner side 21 of the cover member 20, is strain relief ledge 28. When the cover member 20 is secured to the housing 70, an opening 30 is formed between the cover member 20 and the housing 70 at the rear of the connector 10, see FIG. 4. The cables will extend through this opening 30 when the connector 10 is fully assembled. As cover member 20 is rotated from an open position, as shown in FIG. 4, to a closed position, as shown in FIG. 1, the strain relief ledge 28 will rotate into the opening 30 and will engage the cables thereby providing strain relief for the cables and preventing them from being pulled out of the connector 10.

Along the inner side 21, towards the center of the cover member 20, are stuffer members 32. The stuffer members 32 are projections which are aligned with the IDC termination end 78 of the contacts 74. The stuffer members 32 are designed for specific cable assemblies, but they may be designed in other arrangements or configuration for other size of cables. When the cover member 20 is rotated from the open to the closed position, the stuffer members 32 will push the wires into the termination ends 78 of the IDC contact 72.

Along either edge of the cover member 20 are securing arms 34. When the cover member 20 is rotated to the closed position, the securing arms 34 will engage catches 82 to keep the cover member 20 in the closed position.

Along the forward end 23 of the cover member 20, is latching arm 40. The latching arm 40 is recessed in from the material thickness of the cover member 20. The latching arm 40 has pivot hinges 42 extending laterally from the arm 40 and formed integrally with the cover member 20. Along the rear portion of the latching arm is actuation member 44 and along the forward portion of the latching arm is an opening 46 which forms an engagement section with the mating connector.

Figure 3:
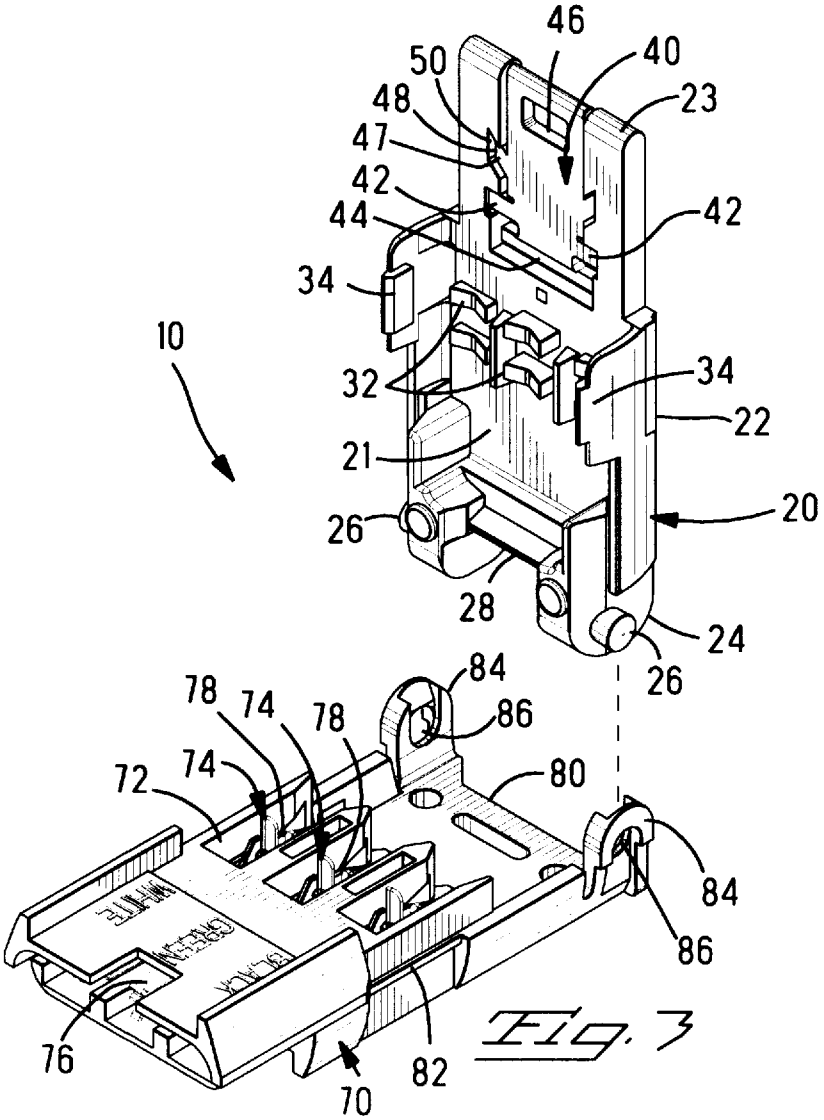
FIG. 3 is an isometric view of the electrical connector prior to the assembly.

As can be seen from FIGS. 1 and 3, the latching arm 40 is made thinner than the surrounding material. This allows the pivot hinge 42 to have greater flexibility than a thicker latching arm would have. This allows the latching arm to more easily pivot than a thicker latching arm to either connect or disconnect with the mating connectors.

The latching arm 40 has strength member or back-up member 47. The strength member 47 provides the latching arm with greater resistance to pull out forces when the pivot hinges 42 begin to fail and move forward. The member 47 also acts as a back-up member in the case of failure of the pivot hinges 42. The strength member 47 is made of tabs which are shaped as swept forward wings 48 on the latching arm 40 and opening 50 on the cover member 20. The swept forward wings 48 fit closely within the opening 50. If the pivot hinges 42 begin to move forward, the swept forward wings 48 will engage edges of the openings 50 thereby providing greater resistance against pull out forces. Even though the wings 48 fit closely within the opening 50, the latch is still able to rotate about the pivot hinges 42 to allow the latching arm 40 to pivot easily. This occurs because the wings 48 are able to easily move through the opening 50 in an up and down motion.

Figure 9:
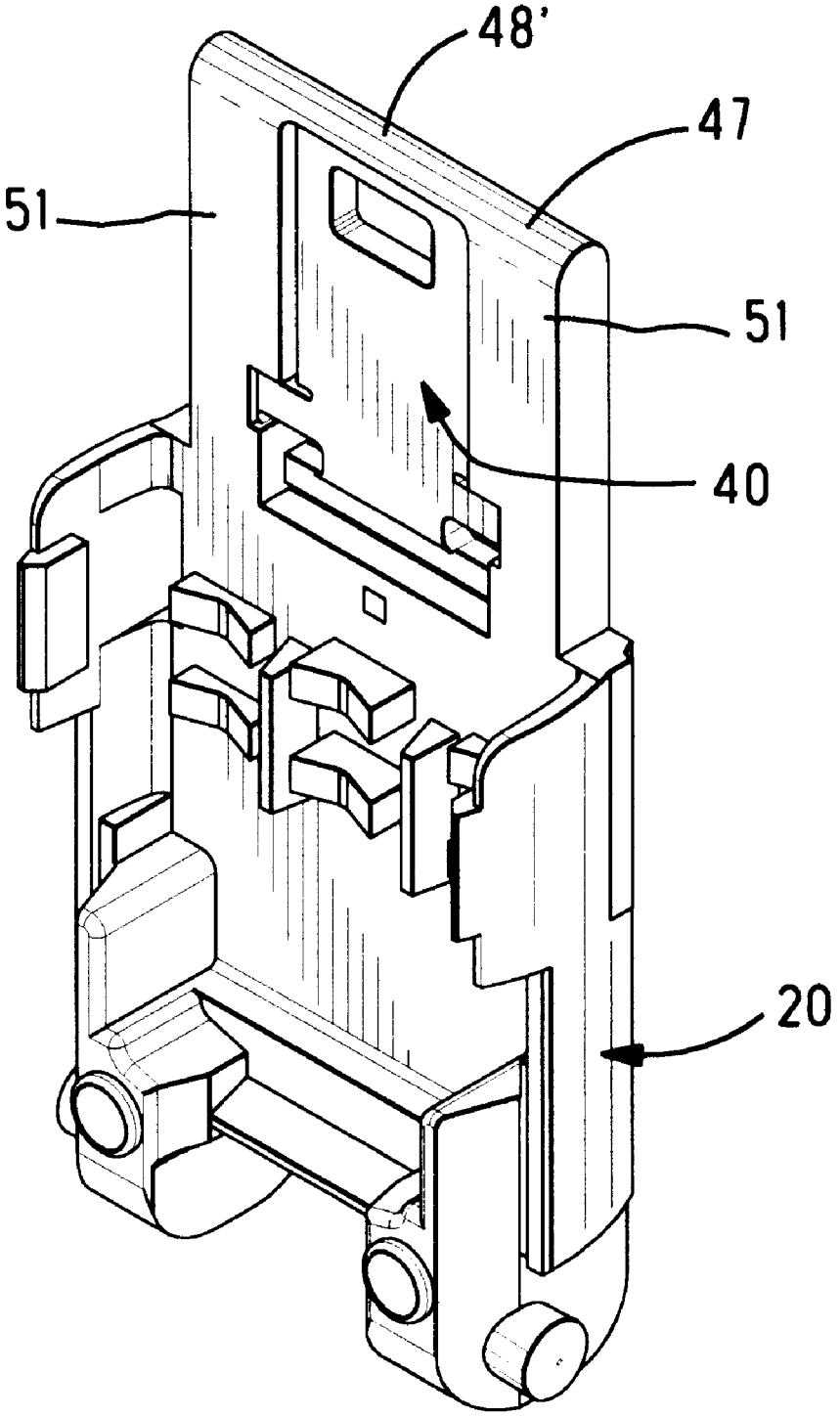
FIG. 9 is an isometric view of the cover member with an alternative embodiment of the latching arm.

The back-up member 46 is shown as swept forward wings, however, the back-up member could also be designed in different configurations. For example, the wings 48 could be lateral to latching arm 40, they could extend perpendicular to the latching arm. The back-up) member 47 could be a cross member 48' that would connect from left to right along the forward end 23 of the cover member 20, see FIG. 9. If the pivot hinges 42 were to fail, the forward end of the latching arm 40 would engage the cross member 48'. FIG. 9 shows the cross member 48' extending along the forward end 23 of the cover member 20. The cross member 48' still allows the latching arm 40 to rotate during latching and unlatching, but if the latching arm 40 where to move forward, the front end of the latching arm 40 would engage the cross member 48' thereby providing back-up to the latching arm 40. A further advantage of the cross member 48' is that the cross member 48' provides greater strength to the side arms 51 which extend along either side of the cover member 20.

In operation, the cable or cables are inserted into the rear portion of the housing 70 so that they are aligned with the termination ends 78 of the IDC contacts 74. The cover member 20 is then secured to the housing 70 by inserting the lugs 26 into the holes 86 and thereby securing the cable or cables within the opening 30. The cover member 20 is then rotated from the open position to the closed position during which time the stuffer members 32 push the cables into the termination ends 78 of the IDC contacts 74.

The connector shown in the drawings is a hermaphroditic connector, that is, the connector 10 mates with an identical connector. The connector 10 has a latching lug 90 disposed along the bottom of the housing 70. The connector 10 is mated with an identical connector which has been flipped upside down with respect to the connector 10. During mating, the latching arm 40 will engage the ramped surface 92 of the latching lug 90, thereby deflecting the latching arm 40. When the connectors 10 are fully mated, the latching lug 90 will be received within the opening 46 on the latching arm 40. Likewise, the latching arm 40 on the mating connector will engage the latching lug 90 on the connector so that each assembled pair of connectors will have two latching arms securing them together.

If a force is applied to the mated connectors tending to pull the connectors apart, such as if the cables were pulled in opposite directions or if the assembly were pulled by one of the cables, the forces will be concentrated in the pivot hinges 42 of each of the connectors. If any of the pivot hinges begin to fail, the swept forward wings 48 will begin to engage the openings 50 in the cover member 20. Therefore, the latching arms 40 become strongest just as the pivot hinges 42 are failing. The strength member in the latching arm 40 provides the latching arm with greater strength than a regular latching arm would have, given the same properties and dimensions.

Figure 5:
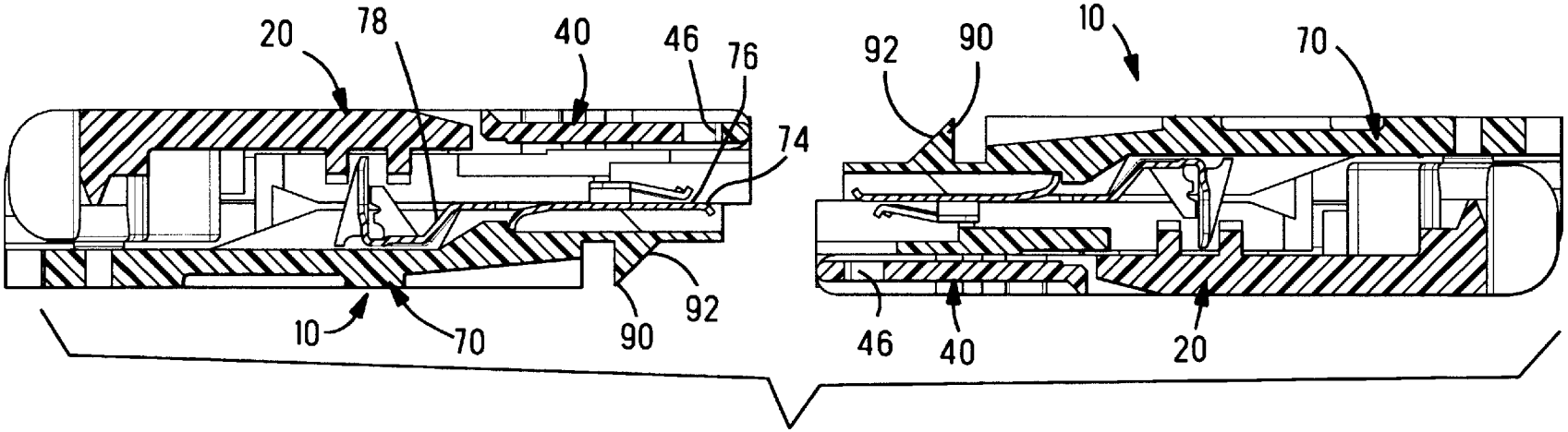
FIG. 5 is a cross-sectional view of the electrical connectors prior to mating.
Figure 6:
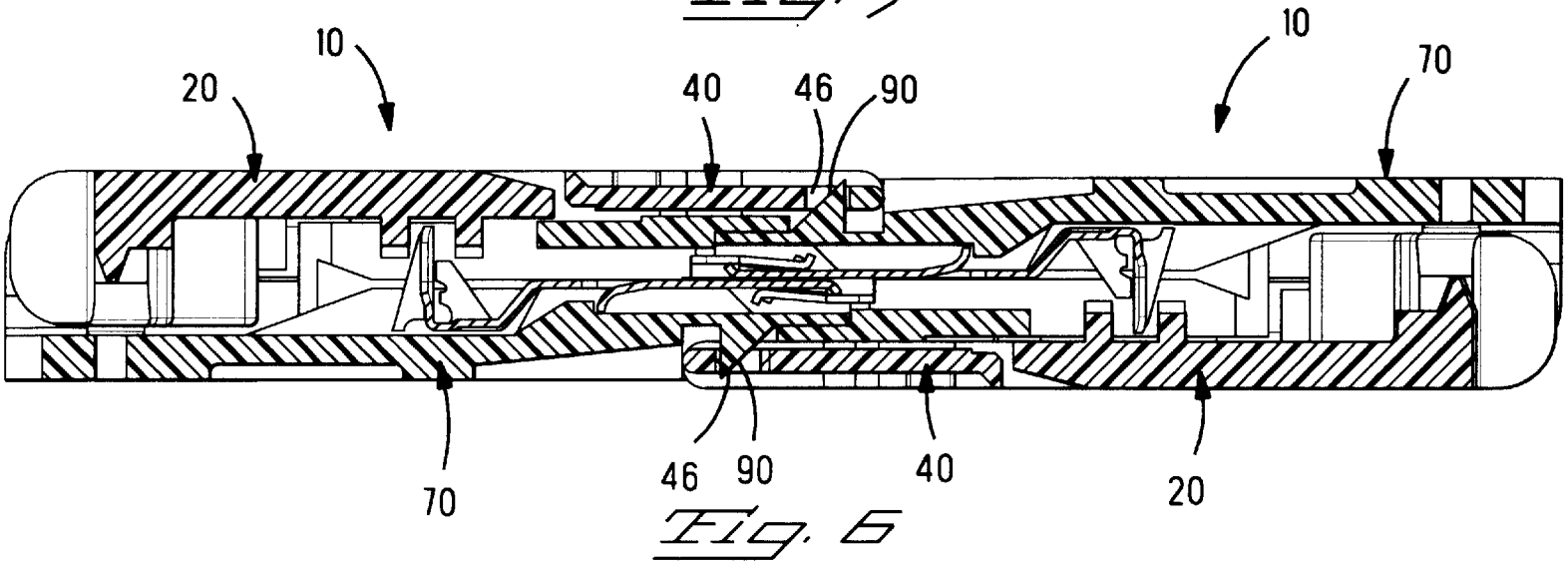
FIG. 6 is a cross-sectional view showing the electrical connectors mated.

FIG. 5 shows a cross sectional view of the electrical connectors 10 prior to mating. As can be clearly seen from this view, each of the connectors 10 have a latching lug 90 disposed opposite to the latching arm 40. When the connectors 10 are mated, as shown in FIG. 6, the latching arm 40 and the lug 90 on the connector on the left in FIG. 6 will engage the lug 90 and the latching arm 40 respectively on the connector on the right.

Figure 7:
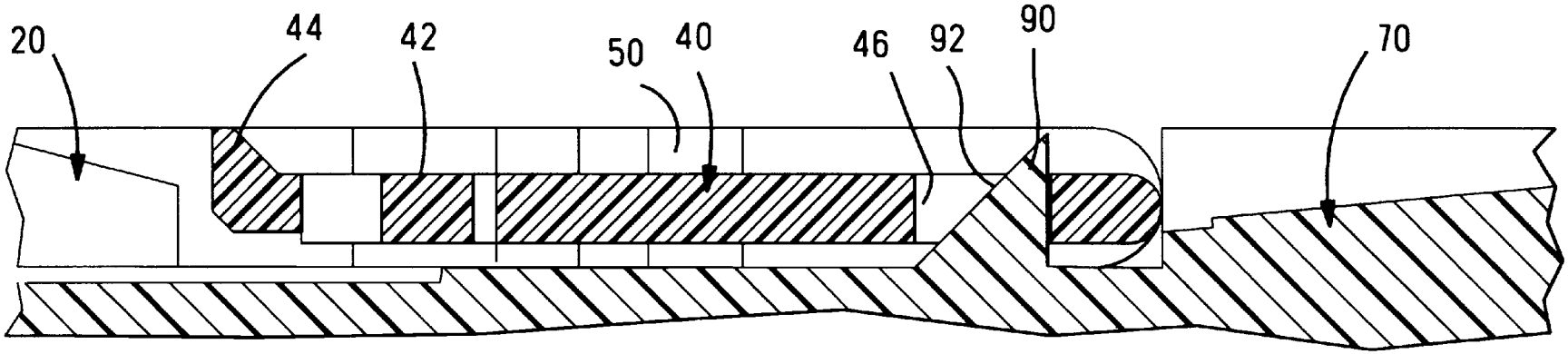
FIG. 7 is a cross-sectional view of the latch member.
Figure 8:
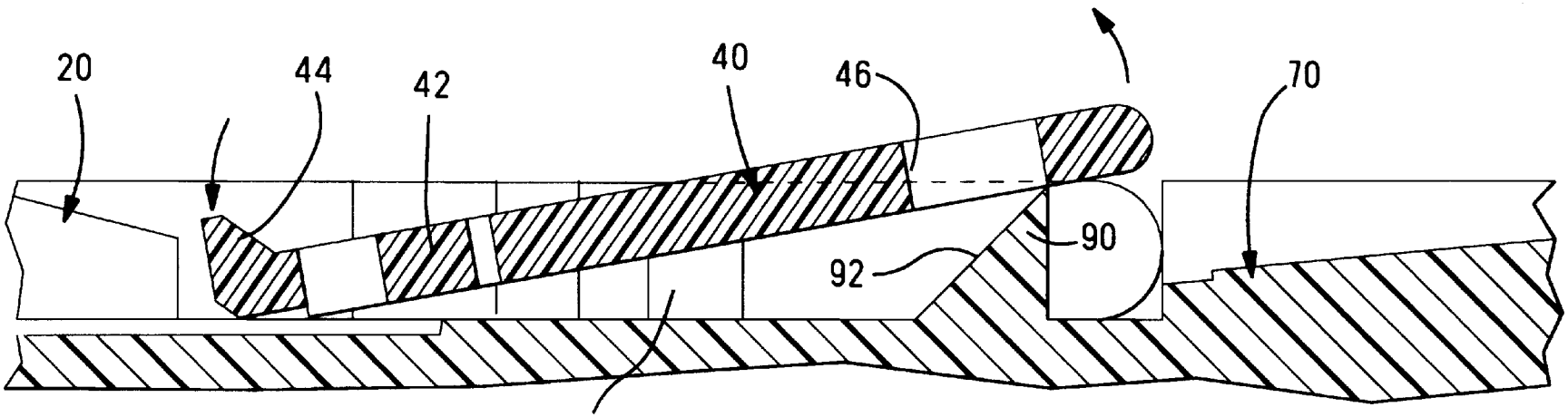
FIG. 8 is a cross-sectional view of the latch in the deflected state.

FIG. 7 shows a cross sectional view of the latching arm 40 and FIG. 8 shows the latching arm in the deflected state. From this view, it is clear that the latching arm 40 pivots about the pivot hinge 42. When the latching arm 40 engages the lug 90, the latching arm is deflected as shown in FIG. 8. Furthermore, when it is necessary to release the connectors, the actuation member 44 is pressed downward, thereby raising the front end of the latching arm 40 and releasing the engagement with the lug 90.

The latching arm of the present invention and many of its attendant advantages will be understood from the foregoing description. It is apparent that various changes may be made in the form, construction, and arrangement of parts thereof without departing from the spirit or scope of the invention or sacrificing all of its material advantages.

We claim:

1. A latching arm for an electrical connector, the latching arm comprising:

a main body including (with) a connection point to (the) an electrical connector housing (of the electrical connector), (the main body having) a securing section for engaging a mating connector, (the main body having) a back-up member for engaging the housing upon weakening of (whereby when the connection point weakens due to stresses on) the connection point, (the back-up member engages the housing thereby maintaining) to maintain a (good) substantially static connection between the electrical connector and the mating connector, the back-up member extending (extends) from the main body (housing) at an angle directed toward the securing section (a forward end of the housing), the housing including (has) an opening angled to match the angle of the back-up member (,) and (the opening engages) engage the back-up member upon weakening of the connection point.

2. The latching arm of claim 1, wherein the connection point is a pivot hinge.

3. The latching arm of claim 1, wherein the main body has an actuation member for pivoting the latch into a disengaged section.

4. A latching arm for an electrical connector, comprising: a main body with a connection point to a housing of the electrical connector, the main body having a securing section for engaging a mating connector, the main body having a back-up member for engaging the housing whereby when the connection point weakens due to stresses on the connection point, the back-up member engages the housing thereby maintaining a good connection between the electrical connector and the mating connector, the back-up member being a tab extending from a side of the main body at an angle, where the angle is directed toward a forward end of the main body, the housing having an opening to engage the tab, and the opening being angled to match the angle of the tab.

5. A latching arm for an electrical connector, the latching arm comprising:

a main body including a leg connecting the latching arm to a housing of (being connected to) the electrical connector;

(the latching arm having) an engagement section for engaging a mating connector;

(the latching arm having) a back-up member for engaging (to engage) the electrical connector housing upon weakening of (when) the leg (is weakened due to stresses), the back-up member including (being) a tab extending from a side of the main body at an angle directed toward th e engagement section, (where the angle is directed toward a forward end of the main body,) the housing having an opening (,and the opening being) angle to match the angle of the tab.

6. The latching arm of claim 5, wherein the leg is a pivot hinge.

7. The latching arm of claim 5, wherein the latching arm has an actuation member for pivoting the latch into a disengaged section.

8. The latching arm of claim 5, wherein the backup member is a swept forward wing and the electrical connector has an opening to engage the swept forward wing.

9. The latching arm of claim 8, wherein the swept forward wing can move through the opening during deflection of the latching arm.

10. The latching arm of claim 5, wherein the tab can move through the opening during deflection of the latching arm.

11. The latching arm of claim 5, wherein the back-up member comprising the front end of the latching arm and the electrical connector includes a cross arm which extends adjacent to the front end of the latching arm.

* * * * *